United States Patent [19]

Cassimatis et al.

[11] 3,955,762

[45] May 11, 1976

[54] ROTATABLE SPRINKLER AND WATER DEFLECTOR USED THEREWITH

[75] Inventors: Peter Nicholas Cassimatis; John Roy McComas, both of Fresno, Calif.

[73] Assignee: Johns-Manville Corporation, Denver, Colo.

[22] Filed: Aug. 13, 1975

[21] Appl. No.: 604,391

[52] U.S. Cl. ..... 239/230; 239/233; 239/500

[51] Int. Cl.[2] ..... B05B 3/14; B05B 1/26

[58] Field of Search .....239/230–233, 499, 500

[56] References Cited

UNITED STATES PATENTS

| | | | |
|---|---|---|---|
| 3,022,012 | 2/1962 | Sharp et al. | 239/230 |
| 3,208,672 | 9/1965 | Sully | 239/230 |
| 3,726,479 | 4/1973 | Leissner et al. | 239/233 |
| 3,746,259 | 7/1973 | Apri | 239/231 X |
| 3,831,853 | 8/1974 | Drori | 239/233 X |

*Primary Examiner*—John J. Love
*Assistant Examiner*—Andres Kashnikow
*Attorney, Agent, or Firm*—Robert M. Krone; Joseph J. Kelly; Stephen C. Shear

[57] ABSTRACT

A rotatable impact sprinkler is disclosed herein and includes a nozzle through which a jet of water issues and an oscillating arm having an end movable in front of and to one side of the nozzle. The sprinkler also includes a water deflector which is connected with this end of the oscillating arm and which is movable into and out of the water jet. The deflector includes three water deflecting surfaces which receive and redirect water from the jet in a smooth, substantially turbulent free manner. This water is first redirected along a first straight path at least approximately 90° from the axis of the jet. It is then redirected along a second path at an acute angle with and in front of the first path and thereafter it is redirected along a third path which is approximately parallel with the axis of the issuing jet.

8 Claims, 10 Drawing Figures

Fig. 1.
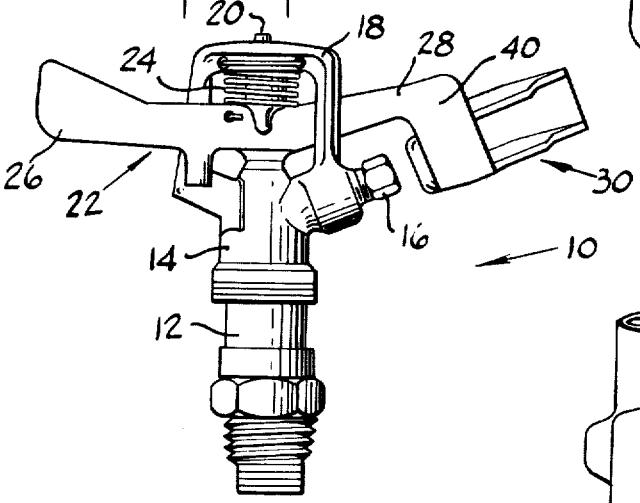
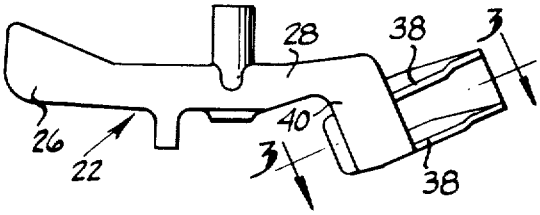
Fig. 2.
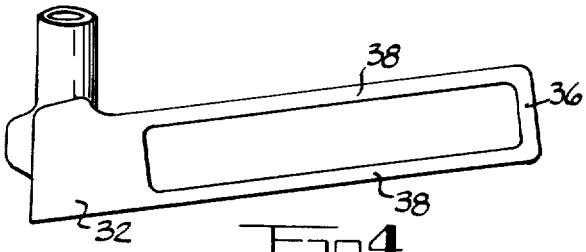
Fig. 4.
Fig. 3.
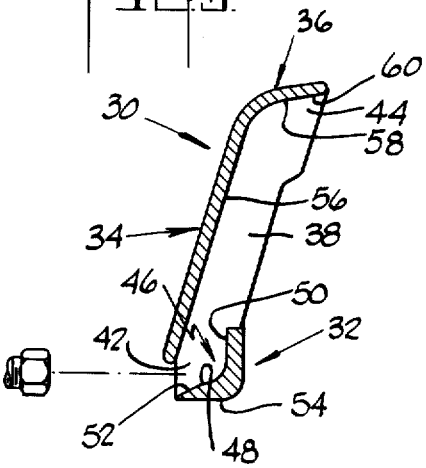
Fig. 5.
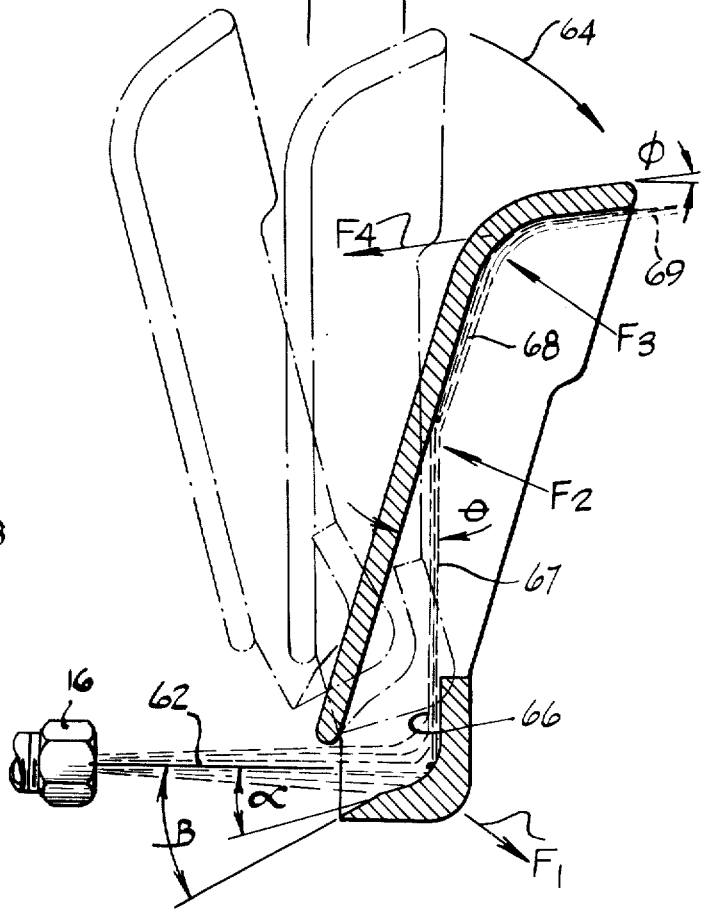
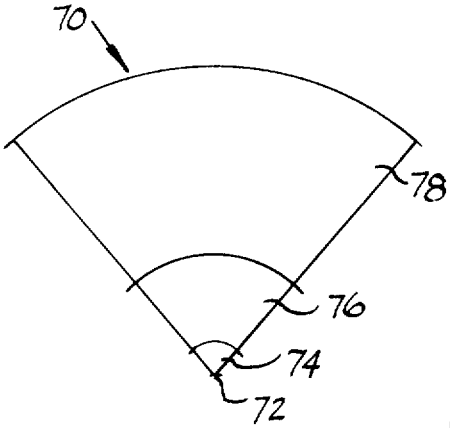
Fig. 6.

ROTATABLE SPRINKLER AND WATER DEFLECTOR USED THEREWITH

BACKGROUND OF THE INVENTION

The present invention relates generally to rotatable impact sprinklers and more particularly to a rotatable impact sprinkler having a partial circle distribution pattern and a water deflector which minimizes sprinkler backsplash and at the same time minimizes flooding at and around the sprinkler itself.

Rotating sprinklers of the impact type are well known in the art. A typical sprinkler of this type includes a sprinkler body having a jet nozzle, an oscillating arm and a water deflector mounted to one end of the arm for movement into and out of a jet of water issuing from the nozzle. The oscillating arm is spring biased against the body of the sprinkler with the deflector in the path of the jet stream of water issuing from the nozzle. In operation, water issuing from the nozzle impinges upon the deflector causing the deflector to move out of the jet and causing the oscillating arm to move out of its biased position. With the deflector out of the jet, the oscillating arm moves back to its biased position and forcibly engages the sprinkler body causing it to rotate an increment. This procedure is then repeated to provide the desired amount of sprinkler rotation.

One drawback with an impulse type rotational sprinkler of the type just described resides in the "backsplash" resulting from the manner in which this type of sprinkler operates. More specifically, much of the water issuing from the jet nozzle and impinging on the deflector is deflected back to one side of the nozzle thereby creating a backsplash. Considering that the deflector typically oscillates into and out of the jet stream at a relatively high rate, for example, 150 times per minute, this backsplash can produce a relatively large amount of water during operation of the sprinkler. Where the particular sprinkler is a full circle sprinkler this backsplash is of no consequence except that the backsplash water could flood around the sprinkler head. Where the sprinkler is one which provides partial circle service, for example, where the sprinkler is located adjacent a walk, a building, or a street, the backsplash may be highly objectionable in that a large amount of water through the course of the sprinkler operation is ultimately directed onto the walk, building or street.

This backsplash drawback has been dealt with and to a large extent minimized by a sprinkler disclosed in U.S. Letters Pat. No. 3,022,012 which is issued on Feb. 20, 1962, to C. R. Sharp and John E. Streeter. This sprinkler as disclosed in the Sharp et al patent utilizes what is referred to as an S-shape reaction member or tube for intermittently deflecting water issuing from the sprinkler nozzle. The reaction tube is permanently fixed to the arm of an oscillating lever also comprising part of the sprinkler such that one end of the reaction tube, specifically the inlet end, is in alignment with the water jet issuing from the nozzle when the oscillating lever is in one extreme position. An intermediate portion of the reaction tube extends laterally at an obtuse angle with the inlet end and the other end of the tube, specifically the discharge end, is offset from but in approximate parallelism with the inlet end.

In operation, the reaction tube disclosed in the Sharp et al patent initially comes into registry with the water jet issuing from the sprinkler nozzle causing water to enter the inlet end of the reaction tube. Before an appreciable flow occurs through the reaction tube, there occurs a momentary force component tending to rotate the reaction tube further into the water jet thereby drawing the tube into its ultimate position in alignment with the sprinkler nozzle. Additional forces are established as a result of the flow of the water jet through the tube, these forces acting to move the tube back out of the path of the water jet, i.e., to one side of the sprinkler nozzle.

In accordance with the disclosure in the Sharp et al patent and from observing the operation of an actual sprinkler constructed in accordance with the Sharp et al patent, there is an increase in the turbulence of the water as it passes through the reaction tube. As used herein and obviously as used in the Sharp et al patent the term "turbulence" refers to a relatively unsmooth flow of water as opposed to a smooth or sheet-like flow. Applicant has found this increase in turbulence to be objectionable for a number of reasons. First, Applicant has found that an increase in turbulence in the reaction tube results in increased flooding of water around and in close proximity to the sprinkler itself, for example within about two feet from the sprinkler. More specifically, much of the water in the tube which is subjected to turbulence does not reach what may be referred to as the intermediate range in the overall water distribution pattern but rather falls substantially short of this intermediate range creating a flood around the sprinkler. This results in a second drawback which is that the intermediate range of the overall pattern which normally receives deflected water does not receive as much water as it otherwise would since much of the deflected water is deflected around the head of the sprinkler. In other words, Applicant has found that the turbulence in the reaction tube produces more water than is desirable around the head of the sprinkler and less water than is desirable in the intermediate range of the pattern. The outer range of the pattern is, of course, for the most part unaffected by this situation since the outer range receives most of its water from the undeflected jet of water issuing from the sprinkler nozzle.

As will be seen hereinafter, the present invention provides a substantial improvement to the sprinkler just described. Briefly, this improvement resides in minimizing substantially if not eliminating the turbulence within the water deflector without adversely affecting the production of required torque forces to produce efficient oscillation of the deflector and oscillating arm. Moreover, the uniformity of the overall distribution pattern has been improved in that much of the water which has heretofore flooded around the sprinkler head is directed further out into the intermediate range of the pattern.

SUMMARY OF THE INVENTION

An object of the present invention is to provide a rotatable impact sprinkler, specifically a partial circle sprinkler, which is uncomplicated in design and economical to manufacture and which provides for an improved overall water distribution pattern.

Another object of the present invention is to minimize if not eliminate the backsplash resulting from the water deflecting operation of this type of sprinkler and at the same time minimizing the degree of flooding which occurs directly in front of the sprinkler itself.

Still another object of the present invention is to direct more of the deflected water into the intermediate range of the overall distribution pattern.

A further object of the present invention is to provide a water deflector for use in a rotatable water impact sprinkler which deflector is an improvement over the deflector disclosed in the aforediscussed Sharp et al patent.

The present invention is directed to a water deflector for use in a rotatable impact sprinkler of the type generally described above, specifically one which includes a nozzle through which a jet of water issues and an oscillating lever or arm mounted to the body of the sprinkler. In accordance with the present invention, this deflector, which is connected with one end of the oscillating arm and which is movable into and out of the jet of water issuing from the nozzle, includes first, second and third water deflecting segments which together carry out the objectives discussed above.

As the water deflector initially moves into the jet of water issuing from the sprinkler nozzle, water impinges on the first deflecting segment, specifically on a curved water deflecting surface comprising part of the first deflecting segment. This curved surface (1) receives the water from the jet in a substantially turbulent free manner, (2) causes the received water to form into a smooth sheet along the surface and (3) directs this sheet of water along a first straight path which is at least approximately 90 degrees from the axis of the jet. At the same time, impingement of the jet on the curved surface produces a torque force in the direction of movement of the deflector, i.e., into the jet, so as to force the deflector further into the jet.

The second water deflecting segment includes a substantially straight surface spaced from the curved surface just discussed and extending at an acute angle, preferably between 15° and 20°, with and in front of the path taken by the sheet of water off the curved surface. This straight surface receives the sheet of water in a substantially turbulent free manner and causes the sheet to move along its surface in a second straight path at this acute angle with the first path. The sheet of water moves along the second path and is received, again in a substantially turbulent free manner, by a second curved surface comprising part of the third water deflecting segment. This second curved surface maintains the water in sheet form and directs it into a third path which is approximately parallel with the axis of the water jet issuing from a sprinkler nozzle. Impingement of the sheet of water on the second and third water deflecting segments produces torque forces, both moment forces resulting from a change in direction and a reaction force resulting from the discharge of the stream which cause the deflector to move back out of the water jet.

With a water deflector of the type just described, the overall impact sprinkler does not produce an appreciable backsplash. Moreover, because of a reduction in turbulence within the deflector, more of the water directed through and deflected by the deflector moves substantially further out from the sprinkler than is the case when the water is subjected to excess turbulence. This not only minimizes flooding at the sprinkler head itself but increases the amount of water directed into the intermediate zone of the overall pattern.

BRIEF DESCRIPTION OF THE DRAWINGS

FIG. 1 is a side elevational view of a rotatable impact sprinkler including an oscillating lever and a water deflector constructed in accordance with the present invention.

FIG. 2 is an enlarged side elevational view of the oscillating lever and water deflector illustrated in FIG. 1.

FIG. 3 is a longitudinal sectional view of the water deflector illustrated in FIG. 2, taken generally along line 3—3 in FIG. 2.

FIG. 4 is a front elevational view of the water deflector illustrated in FIGS. 2 and 3.

FIG. 5 is a view of the water deflector similar to that illustrated in FIG. 3, specifically illustrating the deflector's operation.

FIG. 6 is a diagramatical view indicating the area of coverage of the sprinkler illustrated in FIG. 1.

DETAILED DESCRIPTION AND PREFERRED EMBODIMENT

Figure 7:
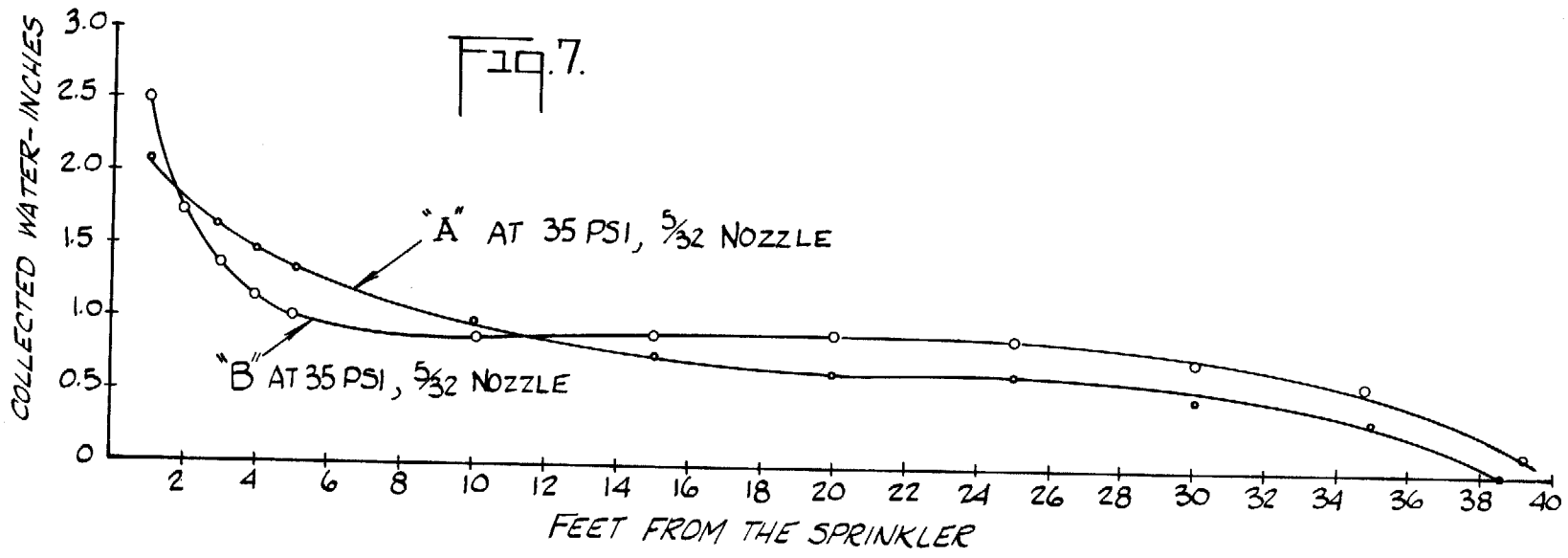
FIGS. 7–10 are comparative graphs illustrating water distribution patterns of a sprinkler constructed in accordance with the present invention and a sprinkler constructed in accordance with the Sharp et al patent.

Turning to the drawings, wherein like components are designated by like reference numerals throughout the various figures, a rotatable impact sprinkler is illustrated in FIG. 1 and generally designated by a reference numeral 10. As shown in FIG. 1, the sprinkler includes a stem 12, the lower end of which is screw threaded for connection to a waater supply line. Sprinkler 10 also includes a body 14 which is conventionally rotatably mounted on the stem and which is provided with a laterally and upwardly directed jet nozzle 16. Extending above the body 14 is a frame 18 having a somewhat rectangular opening and a shaft 20 which extends from body 14 to frame 18 and which bisects the opening defined by the latter.

An oscillating drive member 22 is pivotally mounted about shaft 20 and is biased in one direction by a spring element 24 which is disposed around the shaft and which is connected to the drive member and frame in a conventional manner. Drive member 22 may be separated into two sections, a wieght arm 26 extending approximately horizontally past the frame 18 and an oscillatable drive arm 28 extending laterally and upwardly in approximate parallel relationship to the axis of jet nozzle 16.

In order to effect oscillation of drive member 22 and therefore rotation of sprinkler body 14, sprinkler 10 includes a water deflector 30 which is connected to the free end of drive arm 28 and which is constructed in accordance with the present invention. This water deflector is positioned to move into and out of the water jet issuing from nozzle 16 during operation of sprinkler 10. More specifically, the water deflector functions to produce oscillation of drive member 22 which in turn results in rotation of sprinkler 14, as stated above. In this regard, while not shown, sprinkler 10 includes conventional means to reverse the direction of rotation of sprinkler body 14 and means for limiting the degree of rotation in either direction, i.e., to provide for part circle operation.

In actual operation, as will be discussed in more detail hereinafter, as the water deflector moves into the path of water issuing from nozle 16, it is deflected by the impinging water further into the water jet causing arm 28 to forcibly engage the front of frame 18 (or a fixed extension off of nozzle 16, not shown) to pivot body 14 an increment. It is very quickly thereafter deflected in the opposite direction to cause arm 28 to move away from the front of frame 18 and out of the water stream. As the drive arm moves back to the front of the frame, by force of spring element 24, it hits the frame again to pivot body 14 another increment. This procedure is repeated until sprinkler body 14 moves the desired amount in one direction at which time the reversing mechanism is actuated and the procedure continues for rotating the sprinkler body in the opposite direction.

Turning to FIGS. 2 through 4, attention is specifically directed to water deflector 30 which, as stated, is connected to the free end of oscillatable lever arm 28. This deflector, which is preferably an integrally molded brass unit and which is preferably an integral part of the entire drive member 22, also preferably constructed of brass, includes three main water deflecting segments indicated at 32, 34 and 36, respectively, in FIG. 3. All three of these segments are located between and are interconnected by a pair of longitudinally extending, laterally spaced sidewalls 38 which confine the lateral extent of water passing therebetween. The deflector is held in position, in and out of the water jet issuing from nozzle 16 of sprinkler 10, by an angularly depending section 40 of arm 28, as illustrated in FIG. 2. This angularly depending section is connected directly with one external side of water deflecting segment 32, as indicated in FIG. 3.

As illustrated best in FIG. 3, deflector 30 includes an entry end 42 for passage of water into the deflector between the sidewalls 38 and a discharge end 44 for passage of water out of the deflector. As will be seen hereinafter, when the deflector moves into the water jet issuing from nozzle 16, at least a large amount of this water, preferably all of it, moves into the deflector between the sidewalls via entry 42 and thereafter moves out of the deflector via discharge end 44 in a substantially turbulent free manner, actually forming into a sheet of water as it moves through the deflector. During this movement, the flow of water, actually this sheet of water, is first diverted back at least 90 degrees from the axis of the water jet by water deflecting segment 32 and is then diverted forwardly a small amount by deflecting segment 34 and finally it is diverted into a path approximately parallel to the axis of the water jet, i.e., to the axis of nozzle 16 by deflecting segment 36. This of course all takes place during the period of time that the deflector is in the path of the water jet and hence minimizes or substantially eliminates any backsplash resulting from the inner action between the jet and deflector. However, at the same time, because of the substantially turbulent free manner in which the water flows through the deflector, the amount of water deflected down into an area directly in front of the sprinkler is substantially reduced. Much of this water which would otherwise be so directed as a result of turbulence during the flow through the deflector exits the discharge end 44 of the deflector in a relatively smooth, substantially turbulent manner and with a greater velocity than is obtained under more turbulent conditions. Accordingly, this water is directed out of the deflector greater distances from the sprinkler, specifically into the intermediate zone of the overall water distribution pattern produced by the sprinkler.

As illustrated specifically in FIG. 3, water deflecting segment 32 includes a main curved water deflecting surface 46 which in an actual working embodiment of the present invention has a radius of curvature of approximately 3/16 inch. This surface provides approximately a 90° bend from its water entry end, indicated at 48, to its relatively straight water exit end, indicated at 50. In addition to surface 46, water deflecting segment 32 may include a second water deflecting surface 52 tapering down and away from end 48 of surface 46, preferably merging with the backside 54 of segment 32 at a point. As will be seen hereinafter, this second surface, which in an actual working embodiment tapers down from the entry end of surface 46 at an angle of approximately 10° to 15°, aids in moving entry end 42 of the deflector into the water jet in a substantially turbulent free manner.

Water deflecting segment 34 includes a longitudinally extending, straight water deflecting surface 56 which is spaced from surface 46 and located on the opposite side of entry end 42. As seen in FIG. 3, this surface extends from one side of entry 42 in a direction away from the entry end at an acute angle with the exiting end 50 of surface 46, preferably between 15° and 20° with exiting end 50 and most preferably approximately 17° with this end. Water deflecting segment 36, which is actually a continuation of segment 34 includes a curved water deflecting surface 58 which is actually a continuation of surface 56. Surface 58 curves out and in front of surface 56 in a gradual fashion so that the exit end of this surface, indicated at 60, is approximately parallel with the axis of the water jet as the latter enters entry 42 of the deflector. In an actual working embodiment, surface 58 has a radius of curvature of approximately ⅜ inch.

Turning to FIG. 5, attention is directed to the manner in which deflector 30 functions during the operation of sprinkler 10. In this regard, FIG. 5 illustrates deflector 30 in three positions, one which is indicated by solid lines and the other two of which are indicated by dotted lines. In these dotted line positions, the deflector is shown moving into the axis 62 of the water jet issuing from nozzle as indicated by arrow 64. The solid lines indicate the deflector at its ultimate position within jet 62, i.e., such that lever arm 28 engages against the front of frame 18. In this latter position, it can be seen that the entry end 48 of surface 46 extends below water jet 62, actually the axis of this water jet, at an acute angle $\alpha$ and surface 52 extends below axis 62 at a greater angle, $\beta$. Angle $\alpha$ is preferably between approximately 15° and 20° and angle $\beta$ is preferably between approximately 25° and 35°. In an actual working embodiment of the present invention, angle $\alpha$ is approximately 17° and angle $\beta$ is approximately 30°.

Since the exit end 50 of surface 46 is approximately 90° from the entry end 48, the exit end extends in a direction which is greater than 90° from axis 62, preferably between 105° and 110° when the deflector is in its solid line position. With angle $\alpha$ at 17°, exit end 50 of surface 46 extends back approximately 107° from axis 62, i.e., from the axis of the water jet when the deflector is in the position indicated by solid lines.

Water deflecting surface 56 of water deflecting segments 34 is positioned relative to surface 46, actually end 50, so as to define an acute angle $\theta$ with exit end 50. Angle $\theta$ is preferably between 15° and 20° and in an actual working embodiment is approximately 17°. As stated previously, exit end 60 of curved surface 58 is approximately parallel to the axis of water jet 62. In an actual working embodiment, exit end 60 extends in a direction angled slightly up from axis 62 as indicated by the angle $\phi$. In an actual working embodiment this angle is approximately 7°. However, for purposes of the present invention, the term "approximately parallel" with respect to end 60 and axis 62 is meant to include such slight deviations from a strict parallel relationship.

In actual operation, as deflector 30 moves into water jet 62, as indicated by arrow 64 in FIG. 5 surface 46 of water deflecting segment 32 receives much of the water from the issuing jet, preferably all of the water, in a substantially turbulent free manner. In other words, the water moves smoothly on and over surface 46 in what may be referred to as a sheet or film of water indicated at 66 in FIG. 5. This sheet or film of moving water is redirected by surface 46 along a first straight path, indicated at 67, which is at least approximately 90° from the axis of the jet i.e., in the direction of exiting end 50 of surface 46.

This sheet of water flows along this first path remaining in sheet form until it impinges surface 56 at acute angle $\theta$. Surface 56 receives the sheet of water in a substantially turbulent free manner, i.e., so that the water is maintained in sheet form as it passes over this second surface along a second straight path 68 defined by this surface. The sheet is directed along surface 56 and thereafter passes over surface 58 of water deflecting segment 36, again in a turbulent free manner, i.e., being maintained intact. Surface 58 redirects the water into a third straight path 69 which is approximately parallel with the axis of jet 62.

During movement of water sheet 66 through deflector 30 from entry end 42 to exit end 44, a number of torque forces are produced. First, impingement of the water sheet on surface 46 results in the production of a force $F_1$ in the direction indicated in FIG. 5. This force causes deflector 30 and oscillatable arm 28 to which the deflector is attached to move further into water jet 62 such that arm 28 forcibly engages against the front of frame 18. Thereafter, impingement of the water sheet on surfaces 56 and 58 and change in direction of the sheet result in the production of torque forces $F_2$ and $F_3$ in the directions indicated in FIG. 5. In addition, another torque force $T_4$, i.e., a reaction force results from discharge of the sheet of water out the discharge end of the deflector. These forces produce greater moments than that of $F_1$ and as a result move the deflector and lever arm out of the path of water jet 62. Since the lever arm is spring biased by spring 24 in the direction of arrow 64, this procedure is repeated.

An important aspect of deflector 30 resides in its ability to produce a relatively turbulent free sheet or film of water passing through it even though the water is first diverted at least 90° from the axis of the water jet and then diverted twice agian so that it ultimately emerges from the deflector approximately parallel to the axis of the water. There are a number of advantages which are attained as a result of this substantially turbulent free operation. For example, substantially turbulent free sheet of water 66 passes through the deflector and is expelled out the discharge end 44 at a greater velocity than would be the case where the water passes through in a turbulent state. In addition, better directional control of the discharging water is attained through the formation of the sheet than would be the case under turbulent conditions. Hence, the amount of this discharged water which reaches further out from the sprinkler, i.e., into the intermediate zone of the overall water distribution pattern is maximized and the amount of water which actually finds itself in close proximity of the sprinkler head is minimized.

To illustrate the last advantage just discussed, a rotatable impact sprinkler including a deflector 30 constructed in accordance with an actual working embodiment of the present invention and a rotatable impact sprinkler constructed in accordance with the disclosure in the aforediscussed Sharp et al patent were operated on a calm day (no wind) to compare their respective water distribution patterns. With the exception of the water deflectors, these sprinklers were substantially identical. In making this comparison, a number of water collection tubes having relatively large funnel shaped receiving ends were provided. These collection tubes were first positioned such than one tube was positioned a foot away from the sprinkler. A second tube was positioned two feet from the sprinkler and so on up to the first 5 feet. Thereafter, tubes were positioned in five foot increments, i.e., 10 feet from the sprinklers, 15 feet and so on up to 40 feet. In all, twelve tubes were used and were positioned in a straight line path from the sprinklers. The sprinklers were mounted on a stand and the openings into the tubes were horizontally aligned with the top supporting surface of the stand. The sprinklers were rotated 270° and the collection tubes were located along the bisector of this arc. Because of the funneled shape of the tubes, the water collected therein did not indicate in inches the amount of water actually given off by the sprinkler but rather provided a relative comparison. For example, where 2 inches of water was collected in a given tube by one sprinkler as compared to for example one inch of water collected in the tube by the other sprinkler, this indicated that the first sprinkler provided approximately twice as much water in the tube than the other. By making these relative comparisons, a relative comparison of the overall distribution pattern of the two sprinklers can be obtained.

To more fully understand this comparison, a typical water distribution pattern is illustrated in FIG. 6 and indicated at 70. Note that this is a part circle distribution pattern with the sprinkler location being indicated at 72. This overall pattern may be separated into three zones, a close in zone or flooding zone 74, an intermediate zone 76 and an outer zone 78. Generally zone 74 extends out from point 72 at most approximately 2 to 3 feet. Zone 76 extends out from zone 74 approximately 10–22 feet (12–25 feet from the sprinkler) and zone 78 extends out from zone 76 approximately 15–25 feet (27–50 feet from the sprinkler). These distance figures are intended to be approximate and could change depending upon a number of factors including the size of the sprinkler nozzle, the water pressure used in operating the sprinkler and the size and position of the deflector.

Zone 78 which extends out a substantial distance from point 72, i.e., the point of the sprinkler, it receives most of its water from the undeflected jet issuing from the nozzle of the sprinkler. Both the close in zone 74 and intermediate zone 76 receive their water from the deflected jet, i.e., off of the sprinkler's water deflector. As will be seen below, the sprinkler using deflector 30 constructed in accordance with an actual embodiment of the present invention directed substantially more water into zone 76, i.e., the intermediate zone than did the sprinkler constructed in accordance with the Sharp et al patent and substantially less water in zone 74, i.e., the closein or flooding zone.

Figure 8:
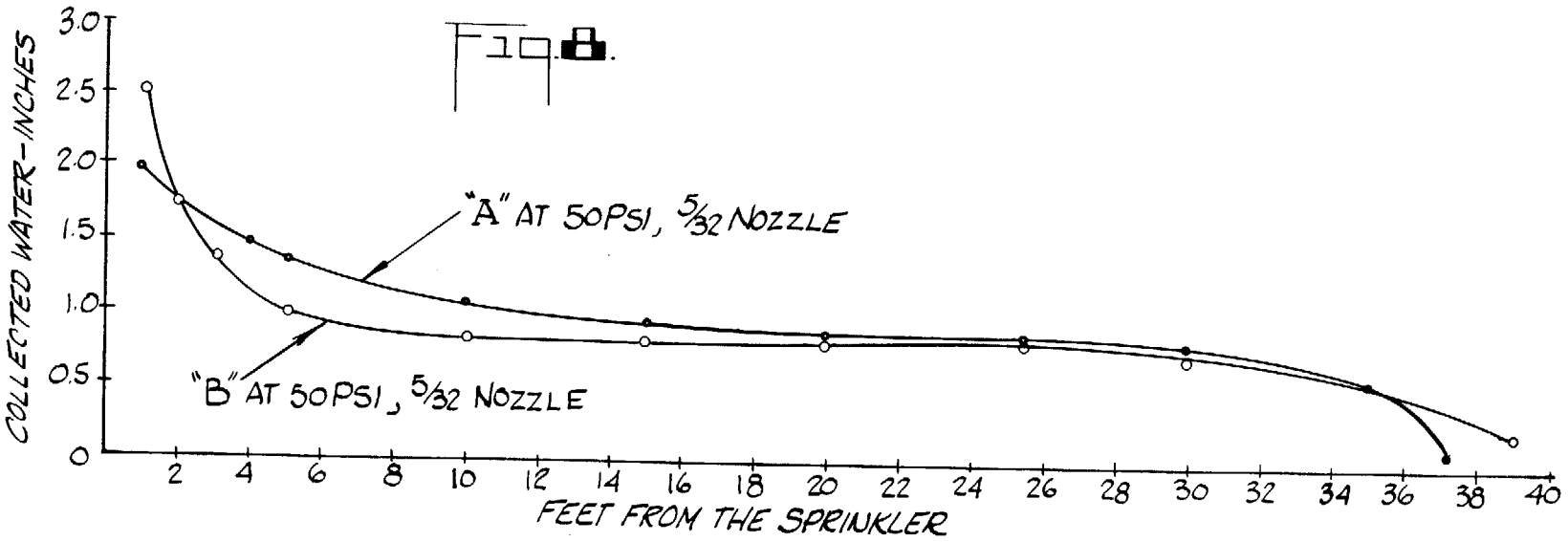

Turning to FIGS. 7 and 8, two sets of graphs are illustrated. In both figures, the X-axis represents distance in feet form the sprinklers and the Y-axis represents the amount of water in inches collected in the aforediscussed collection tubes. The curves designated "A" in both FIGS. 7 and 8 represent the water distribution pattern for the sprinklers of the present invention and the curves designated "B" represent the water distribution pattern for the sprinkler constructed in accordance with the Sharp el al patent. In all cases, the sprinkler nozzles were 5/32 inch and the sprinklers were operated at 35 psi pressure (FIG. 7) or 50 psi (FIG. 8). In addition, in all cases, the actual data obtained is represented by the heavy dots with the overall curves having been made therefrom.

From the results obtained, it can be seen that the "A" sprinkler i.e., the sprinkler of the present invention, directed less water into the close in range (1–2 feet) than the "B" sprinkler, i.e., the sprinkler constructed according to the Sharp et al patent, at both 35 psi and 50 psi. However, at between approximately 2 feet and 10–12 feet at 35 psi and between approximately 2 feet and 14–16 feet at 50 psi, more water was received from the "A" sprinkler than the "B" sprinkler. In other words, the sprinkler of the present invention directed more water into the intermediate range of the distribution pattern than did the "B" sprinkler but less in the close in range.

Figure 9:
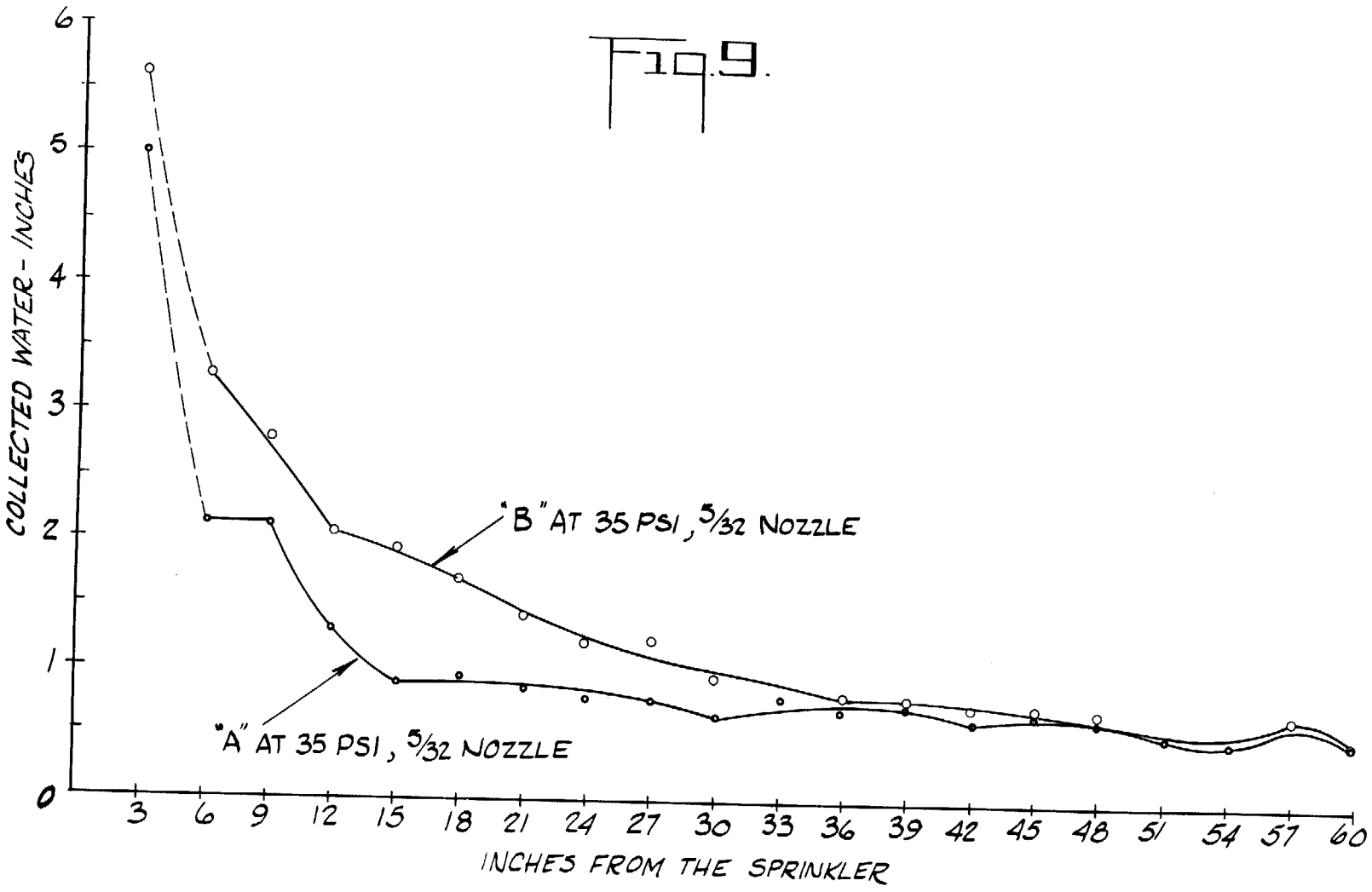
Figure 10:
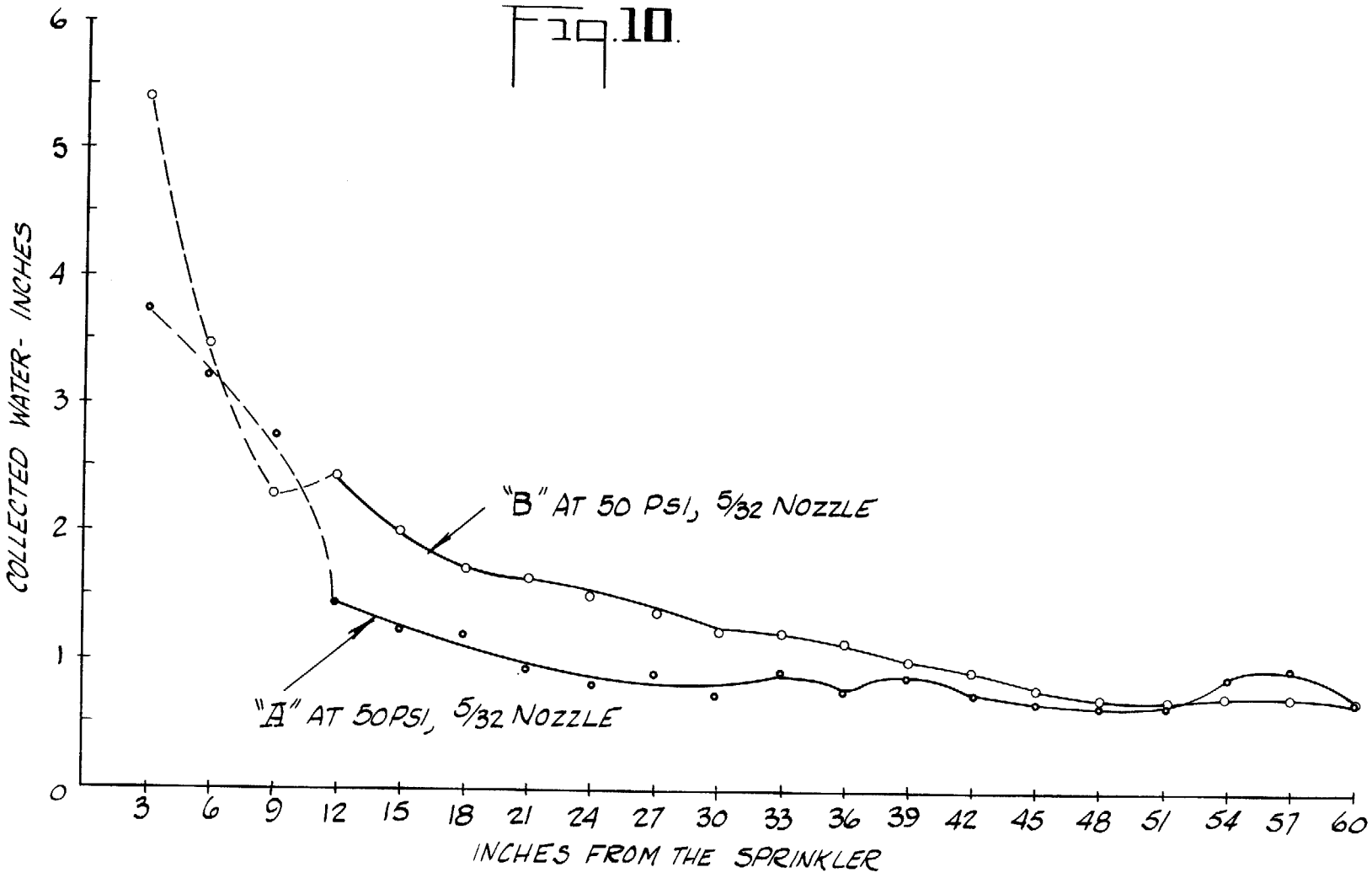

FIGS. 9 and 10 illustrate results of comparative tests respectively identical to those represented in FIGS. 7 and 8 with one exception. The collection tubes were placed every 3 inches from 3 inches out from the sprinklers to 5 feet out. While the data appears to be somewhat erratic at the 3, 6 and 9 inch points of collection (in both figures), the results appear much less erratic from the one foot point to the 5 foot point. Note that at both 35 psi and 50 psi, the "A" sprinkler directed less water into the 1–3 foot range than did the "B" sprinkler, i.e., into the close in range of the water distribution pattern.

It is to be understood that the foregoing comparative tests have been provided for illustrative purposes only. They represent approximate water distribution patterns for two sprinklers, one which generally typifies the present invention and one which generally typifies the Sharp et al patent disclosure. However, it is believed that the results attained illustrate that the deflector constructed in accordance with the present invention directs less water into the close in range (1–3 feet) of the overall water distribution pattern than the deflector disclosed in Sharp et al and more in the intermediate range.

What we claim is:

1. In a rotatable sprinkler including a nozzle through which a jet of water issues and an oscillatable arm having an end movable in front of and to one side of said nozzle, a water deflector connected with said end and movable into and out of said jet, said deflector comprising:

a. first deflector means including a first curved surface movable into the axis of said jet, said curved surface
   i. receiving water from said jet in a substantially turbulent free manner,
   ii. causing said received water to form into a substantially smooth sheet along said surface, and
   iii. directing said sheet of water in a first straight path which is at least approximately 90° from the axis of said jet;

b. second deflector means including a substantially straight surface spaced from said curved surface and extending at an acute angle with and in front of said first path, said straight surface
   i. receiving said sheet or water in a substantially turbulent free manner, and
   ii. causing said sheet to move along said straight surface in a second straight path at said acute angle with said first path; and c. third deflector means including a second curved surface extending in front of and joining said straight surface, said second curved surface
   i. receiving said sheet of water from said straight surface in a substantially turbulent free manner,
   ii. causing said sheet to move along said second curved surface, and
   iii. directing said sheet in a third straight path which is approximately parallel with the axis of said jet.

2. A deflector according to claim 1 wherein said first path is at an angle between approximately 90° and 120° from the axis of said jet and wherein said acute angle is between approximately 15° and 20° with said first path.

3. A deflector according to claim 1 wherein said first, second and third deflector means include opposite side wall means confining the lateral extent of said sheet of water as said sheet moves over said surfaces.

4. In a rotatable sprinkler including a nozzle through which a jet of water issues and an oscillatable arm having an end movable in front of and to one side of said nozzle, an integral deflector integrally connected with said oscillatable arm at said end and movable into and out of said jet, said deflector comprising;

a. first deflector means including a first curved surface movable into said jet, said surface including
   i. a water entry segment extending towards said nozzle at an angle of between approximately 15° and 20° with the axis of said jet when said deflector is at its maximum extent into said jet, and
   ii. a water exit segment extending to one side of said entry segment at an angle of approximately 90° with said entry segment;

b. said curved surface
   i. receiving water from said jet in a substantially turbulent free manner,
   ii. causing said received water to form into a substantially smooth sheet along said surface, and
   iii. directing said sheet of water in a first straight path which is at least approximately 90° from the axis of said jet;

c. second deflector means including a substantially straight surface space from the water exit segment of said first curved surface and extending in front of said first path at an acute angle of between approximately 15° and 20° with said first path, said straight surface
   i. receiving said sheet of water in a substantially turbulent free manner, and
   ii. causing said sheet to move along said straight surface in a second straight path at said acute angle with said first path; and d. third deflector means including a second curved surface extending in front of and joining said straight surface, said second curved surface
   i. receiving said sheet of water from said straight surface in a substantially turbulent free manner,
   ii. causing said sheet to move along said second curved surface, and iii. directing said sheet in a third straight path which is approximately parallel with the axis of said jet.

5. A deflector according to claim 4 wherein said first curved surface has a radius of curvature of approximately 3/16 inch and said second curved surface has a radius of curvature of approximately ⅜ inch.

6. A deflector according to claim 5 wherein said first, second and third deflector means include opposite side wall means confining the lateral extent of said sheet of water as said sheet moves over said surfaces.

7. A deflector according to claim 6 wherein said water entry segment of said first curved surface extends towards said nozzle at an angle of approximately 17° with the axis of said jet when said deflector is at its maximum extent into said jet and wherein said straight surface extends in front of said first path at an angle of approximately 17° with said first path.

8. A rotatable sprinkler including a sprinkler body adapted for connection to a source of water under pressure and having a nozzle through which a jet of water issues along a predetermined axis, and an oscillating arm mounted to said body for movement in an oscillatory manner, said arm including one end movable in front of and to one side of said nozzle, the improvement comprising:

a. a water deflector connected with said one end of said oscillating arm and movable in one direction into said jet and against said sprinkler body and in an opposite direction out of said jet;

b. said deflector including i. first deflector means having a first curved surface which upon entering said jet receives water from said jet in a substantially turbulent free manner and directs said water in a first straight path at least approximately 90° from the axis of said jet, said water upon impinging said surface causing said deflector to move further into said jet and against said sprinkler body, ii. second deflector means having a straight surface spaced from said curved surface and extending at an acute angle with and in front of said first path, said straight surface receiving water from said first surface in a substantially turbulent free manner and directing said received water along a second path along said second surface, and iii. third deflector means including a second curved surface extending in front of and joining said straight surface, said second curved surface receiving the water from said straight surface in a substantially turbulent free manner and directing said water in a third straight path approximately parallel with the axis of said jet;

c. said water impinging said straight surface and said second curved surface causing said deflector to move out of engagement with said body and out of said jet; and d. said surfaces cooperating with one another and with said issuing jet from said nozzle such that the water passing over these surfaces is in the form of a substantially smooth sheet.

* * * * *